US005452902A

United States Patent [19]

Foster et al.

[11] Patent Number: 5,452,902

[45] Date of Patent: Sep. 26, 1995

[54] GAME METHOD WITH VELCRO-RECEPTIVE BALLS AND VELCRO-BEARINGS DISKS

[75] Inventors: George Foster, Signal Hill, Calif.; Elliot Rudell, 1619 Gramercy Ave., Torrance, Calif. 90501; Ian Osborne, Manhattan Beach, Calif.

[73] Assignee: Rudell; Elliot, Torrance, Calif.

[21] Appl. No.: 276,818

[22] Filed: Jul. 18, 1994

[51] Int. Cl.[6] ..... A63B 67/00

[52] U.S. Cl. ..... 273/346; 273/342; 273/DIG. 30

[58] Field of Search ..... 273/342, 346, 273/DIG. 30, 344, 345, 347

[56] References Cited

U.S. PATENT DOCUMENTS

| | | | |
|---|---|---|---|
| 2,187,524 | 1/1940 | Price | 273/344 |
| 4,718,677 | 1/1988 | Barnes | 273/346 X |
| 4,735,420 | 4/1988 | Seidler | 273/346 X |
| 4,995,617 | 2/1991 | Lee | 273/346 |
| 5,195,745 | 3/1993 | Rudell et al. | 273/346 X |

*Primary Examiner*—William H. Grieb

*Attorney, Agent, or Firm*—Blakely, Sokoloff, Taylor & Zafman

[57] ABSTRACT

An action game whereby the players throw a ball at a plurality of disks so that one of the disks becomes attached to the ball. The ball and disks are covered with hook and loop material, wherein the disks will become attached to the ball when the ball comes into contact with a disk. A variety of games can be played with the game set of the present invention. For example, the disks can all be placed in an area of a playing surface. Each player throws the ball at the disks, trying to get a disk to stick to the ball. The ball is bounced off of the playing surface and caught by the opposing player. If a disk sticks to the ball, the opposing player must keep the disk. When all of the disks have been removed from the playing surface, the player with the least amount of disks wins the game.

12 Claims, 2 Drawing Sheets

GAME METHOD WITH VELCRO-RECEPTIVE BALLS AND VELCRO-BEARINGS DISKS

BACKGROUND OF THE INVENTION

1. Field of the Invention

The present invention relates to an action game wherein a VELCRO covered ball is thrown at a plurality of VELCRO covered disks to attach a disk to the ball.

2. Description of Related Art

Hook and loop material which is commonly known as VELCRO is used in a variety of different game sets. For example, Impulse Ltd. marketed a VELCRO game set under the trademark STICKY FINGERS that contained baseballs, footballs, disks and corresponding gloves which were covered with hook and loop material to assist in catching the projectiles. U.S. Pat. No. 4,995,617 issued to Lee discloses a similar VELCRO game set which includes a disk and a corresponding glove that are covered with hook and loop material. U.S. Pat. No. 5,195,745 issued to Rudell et al., discloses a football and glove game set which have corresponding hook and loop material that is used to grasp the football. All of these games involve the mere throwing and catching of a projectile. It would be desirable to have a VELCRO based game set that involved more skill than throwing and catching a projectile, to thereby stimulate more interest in the game and provide more entertainment for the players.

SUMMARY OF THE INVENTION

The present invention is an action game whereby the players throw a ball at a plurality of disks so that one of the disks becomes attached to the ball. The ball and disks are covered with hook and loop material, wherein the disks will become attached to the ball when the ball comes into contact with a disk. A variety of games can be played with the game set of the present invention. For example, the disks can all be placed in an area of a playing surface. Each player throws the ball at the disks, trying to get a disk to stick to the ball. The ball is bounced off of the playing surface and caught by the opposing player. If a disk sticks to the ball, the opposing player must keep the disk. When all of the disks are removed from the playing surface, the player with the least amount of disks wins the game.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
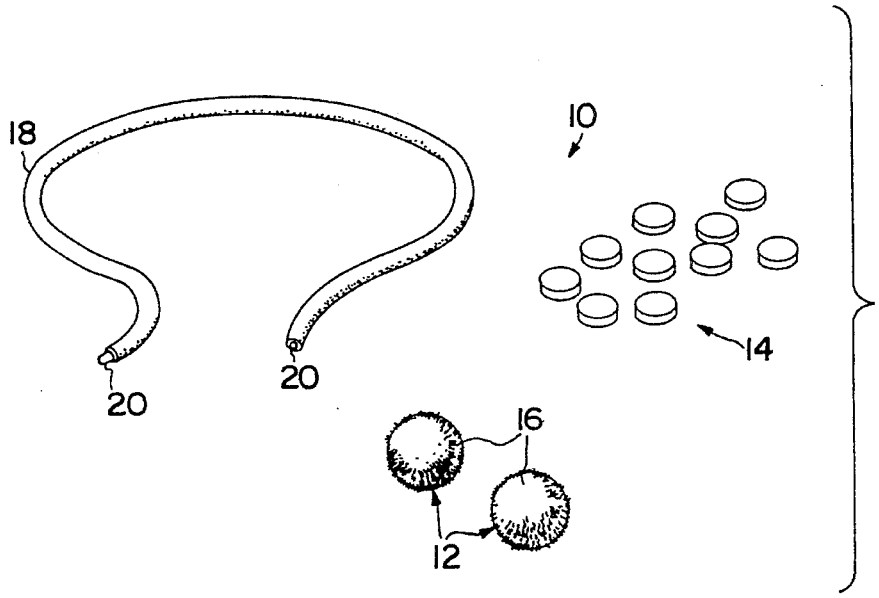
FIG. 1 is a top view of a game set of the present invention.

Referring to the drawings more particularly by reference numbers, FIG. 1 shows a game set 10 of the present invention. The game set 10 includes a pair of balls 12 and a plurality of disks 14. In the preferred embodiment, there are ten disks 14. Some of the disks 14 may have different diameters and have different colors than the other disks 14. In the preferred embodiment, the disks 14 each have a diameter between 0.75 to 4.0 inches. The balls 12 are preferably 2–6 inches in diameter. The balls 12 and disks 14 are covered with an attachment material 16 so that the disks 14 become attached to the balls 12 when the balls 12 come into contact with the disks 14. In the preferred embodiment, the attachment material is hook and loop material commonly referred to as VELCRO. The game set 10 may also have a string 18 that can be used to create boundaries for the games played with the game set 10. The string 18 preferably has attachment members 20, such as clips, which allow the ends to be attached so that the string 18 can be formed into a circle. Although two balls 12, tend disks 14 and one string 18 are shown and described, it is to be understood that any number of elements can be provided in the game set.

Figure 2:
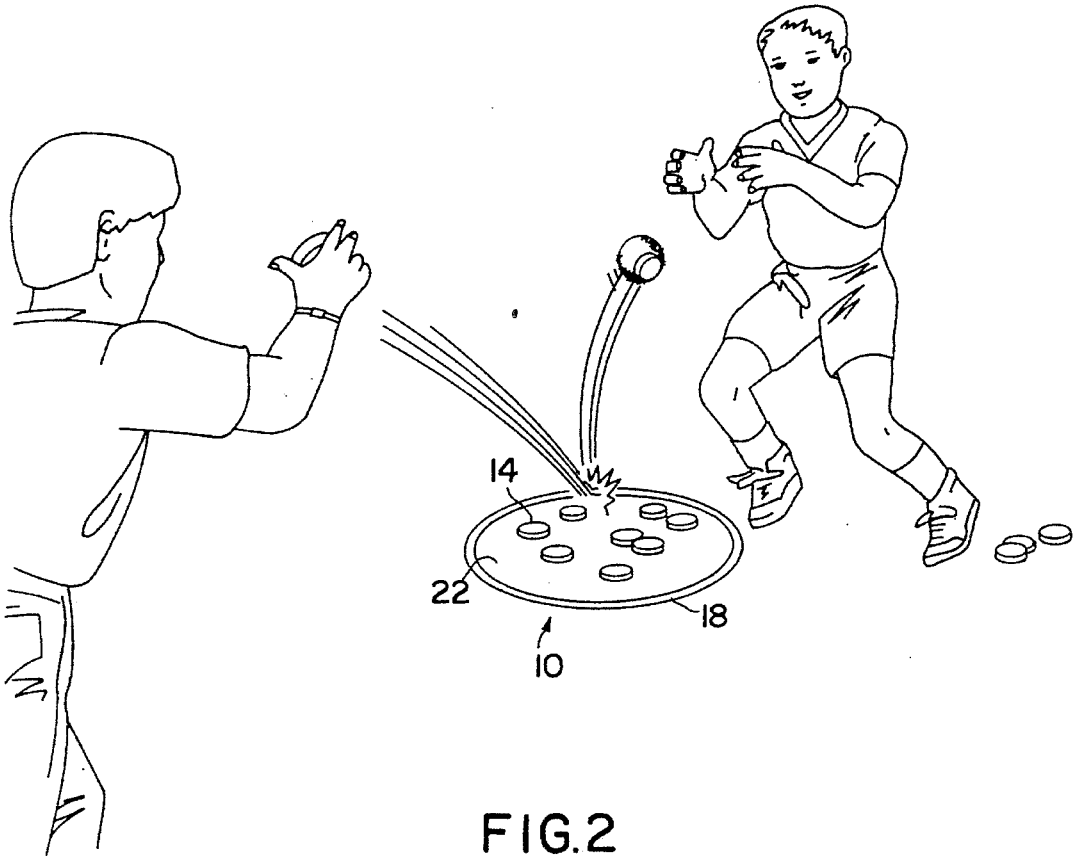
FIG. 2 is a perspective view showing players playing a first game of the present invention.

FIG. 2 shows two players playing a first game with the game set 10. In the first game, the string 18 is formed as a circle and placed onto a playing surface 22. The disks 14 are then placed within the circular string 18. One of the players throws a ball 12 at the disks 14 within the circle. The player tries to strike one of the disks 14 so that the disk 14 sticks to the ball 12. The ball 12 is bounced off of the playing surface 22 and caught by the opposing player. If one of the disks 14 stuck to the ball 12, the opposing player must remove and keep the disk 14.

After catching the ball 12 the opposing player throws the ball 12 at the disks 14. The players take turns throwing the ball 12 at the disks 14 until all of the disks 14 have been removed from the circle. The player with the least amount of disks 14 at the end of the game wins. An opposing player is thereby penalized when the player causes a disk 14 to stick to the ball 12. If various disks 14 sizes are used, different points may be provided for each disk. For example, 2 points may be allocated for small disks and 1 point may be allotted for larger disks. The player with the most points at the end of the game loses.

Figure 3:
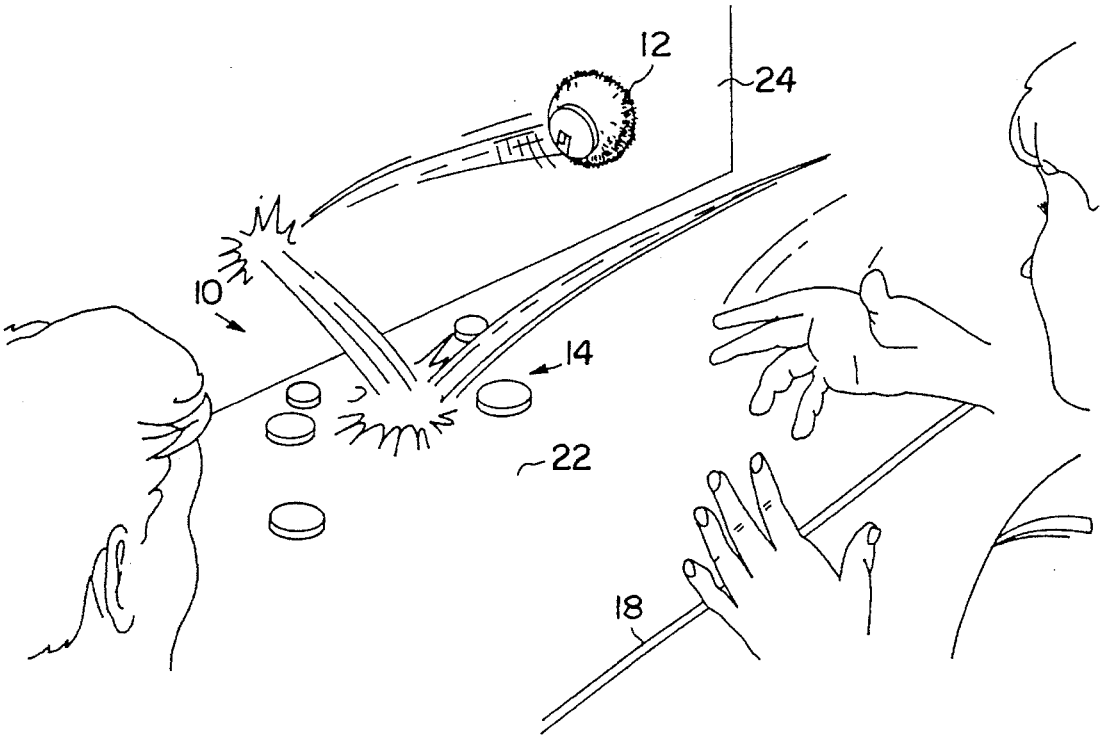
FIG. 3 is a perspective view showing players playing a second game of the present invention.

FIG. 3 shows two players playing a second game with the game set 10. The disks 14 are placed onto an area of a first playing surface 22 that is adjacent to a second playing surface 24 such as a wall. The string 18 is laid down in a straight line a predetermined distance from the wall 24. The string 18 functions as a boundary that the players cannot cross while playing the game.

Each player takes a turn throwing the ball 12 at the disks 14 and trying to make a disk 14 stick to the ball 12. The ball 12 must also bounce off of the wall 24 and back to the player. The addition of the second playing surface 24 increases the skill level of the game. The player keeps each disk that sticks to the ball 12. The game is played until all of the disks have been removed from the playing surface 22. The player with the most disks wins the game. For a game set with various size disks 14, the player with the most points wins the game.

Figure 4:
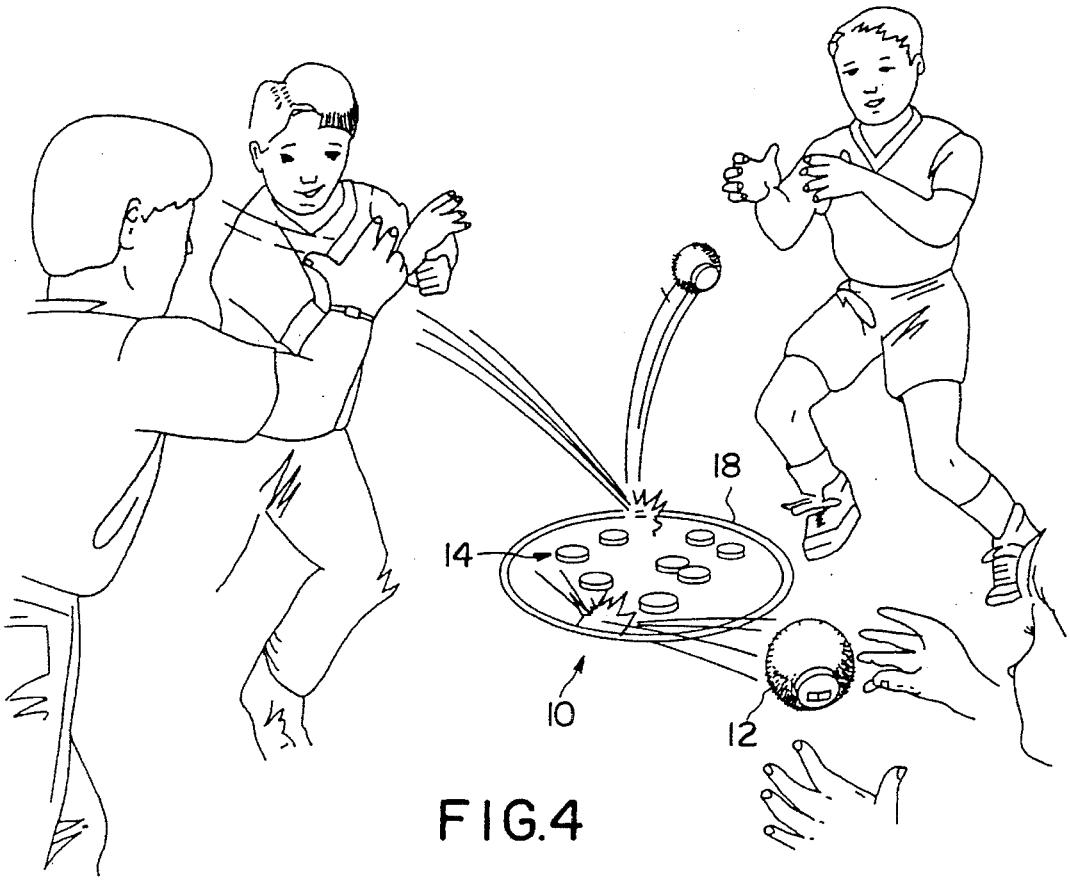
FIG. 4 is a perspective view showing players playing a third game of the present invention.

FIG. 4 shows four players playing a third game with the game set 10. The string 18 is again shaped into a circle and all of the disks 14 are placed within the circular boundary of the string 18. The players play as a team. Each set of players throws a ball 12 at the disks 14 trying to attach a disk 14 to the ball 12. A player who catches a ball with a disk 14 attached thereto keeps the disk 14. The players keep throwing the balls into the circle until all of the disks 14 have been removed from the playing surface. The team with the most disks 14 wins the game. For a game set with various size disks the team with the most points wins the game. The team that is capable of throwing the ball into the circle more than the other team has a higher probability of retrieving more disks. The third game therefore requires skill in both accurately throwing the ball and catching the ball. Although two players were shown in the first and second games, and four players were shown in the third game, it is to be understood that the game can be played with any number of players.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A toy kit, comprising:

a disk that has a pair of opposing flat surfaces with an attachment material on at least one of said flat surfaces, wherein said disk lies flat on a playing surface when either flat disk surface is placed onto the playing surface; and, a ball with a surface area covered with said attachment material such that said disk becomes attached to said ball when any area of said ball comes into contact with said disk.

2. The toy kit as recited in claim 1, further comprising a string with a pair of ends that can be attached to form a circle, wherein said disk is located within said circle.

3. The toy kit as recited in claim 1, wherein said attachment material is hook and loop material.

4. The toy kit as recited in claim 1, wherein the kit has a plurality of disks.

5. The toy kit as recited in claim 4, wherein some disks have a larger diameter than other disks.

6. The toy kit as recited in claim 1, wherein the kit includes two balls covered with said attachment material and ten disks covered with said attachment material.

7. A method for playing a game, comprising the steps of:

a) placing a disk onto a first playing surface, wherein said disk has a pair of flat surfaces with an attachment material on at least one of said flat surfaces, wherein said disk lies flat on the first playing surface when either flat disk surface is placed onto the first playing surface; and, b) throwing a ball that has a surface area that is covered with said attachment material at said disk, such that said disk becomes attached to said ball when any area of said ball comes into contact with said disk, and said disk is removed from the first playing surface.

8. The method as recited in claim 7, wherein a plurality of disks are placed onto the first playing surface.

9. The method as recited in claim 8, further comprising the step (c) of catching said ball by an opposing player, wherein each player is credited with at least one point when that player attaches one of said disk to said ball, steps (b) and (c) are repeated until all of said disks have been removed from the first playing surface, the player with the most points wins the game.

10. The method as recited in claim 9, wherein said ball must be bounced off of a second playing surface.

11. The method as recited in claim 8, further comprising the steps (c) and (d) of catching said ball by an opposing player, removing said disk that is attached to said ball, the player that removes said disk is credited with at least one point for each removed disk, steps (b), (c) and (d) are repeated until all of said disks have been removed from the first playing surface, the player with the least points wins the game.

12. The method as recited in claim 8, wherein the game has two balls and two sets of players that each throw one of said balls at said disks and off of the first playing surface so that said ball can be caught by the other player in the player set, wherein each set of players is credited with at least one point when one of the players within the player set attaches one of said disks to said ball, the steps of throwing and catching said ball are repeated until all of said disks have been removed from the first playing surface, the player set with the most points wins the game.

* * * * *